US005938283A

United States Patent [19]

Babcock et al.

[11] Patent Number: 5,938,283

[45] Date of Patent: Aug. 17, 1999

[54] WHEELCHAIR COMPATIBLE LAWN SWING

[76] Inventors: Martin Babcock, 2214 Tower Ct., Woodbury, Minn. 55125; George Knutsen, 10051 Kerry Ct., Hugo, Minn. 55038

[21] Appl. No.: 08/934,605

[22] Filed: Sep. 22, 1997

[51] Int. Cl.[6] ..... A47D 13/10

[52] U.S. Cl. ..... 297/273; 297/278; 472/118

[58] Field of Search ..... 297/273, 276, 297/277, 278, 279, 280, 281, 282; 472/118, 119, 120, 121, 125, 124

[56] References Cited

U.S. PATENT DOCUMENTS

D. 366,156 1/1996 Babcock et al. ..... D6/334

539,723 5/1895 Caisse ..... 297/273

1,259,061 3/1918 Whetstone ..... 297/273 X 1,335,776 4/1920 Young ..... 297/273 X 4,620,702 11/1986 Hemmeter ..... 297/273 X

FOREIGN PATENT DOCUMENTS 2195259 4/1988 United Kingdom ..... 472/118

*Primary Examiner*—Laurie K. Cranmer

*Attorney, Agent, or Firm*—D. L. Tschida

[57] ABSTRACT

A free-standing lawn swing having a fold down platform which permits access by wheelchair bound users. A ramp platform pivots from a support platform. A crank arm linkage raises and lowers the ramp platform between reclined, loading, and raised, safety positions. A ground ramp section mates to the ramp platform.

13 Claims, 5 Drawing Sheets

WHEELCHAIR COMPATIBLE LAWN SWING

BACKGROUND OF THE INVENTION

The present invention relates to lawn swings and, in particular, to a free standing swing having a support platform adapted to permit access by wheelchair bound users.

A popular past time of the elderly, and not so elderly, is to leisurely enjoy the outdoors from the seat of a lawn swing. Depending upon circumstance and availability, a variety of swings exist. Some consist of a rope or chain, which is supported from a dwelling or tree, and is attached to a seat. The seat may be a tire, a board or a bench and can support one or more users.

A variety of free standing swings also exist which can simultaneously support a number of users. Various swings of this type are constructed of woven wicker, slatted wood and logs. One swing of this latter type which is constructed of durable and long lasting materials and which bears resemblance to the subject invention is shown at U.S. Pat. No. Des 366,156.

Although the foregoing swings accommodate a broad cross section of users from infants to adults, the swings do not accommodate the infirm, handicapped or elderly, especially individuals bound to wheelchairs. These persons are able to access such swings only with difficulty and must transfer to the available bench seat. An attendant normally must assist the user and straps or restraints may have to be used to secure the user to the swing.

To overcome the foregoing deficiencies, the free standing swing of the invention was developed to provide a ramp assembly by which wheelchair users may gain access to a swing. The user is thereby able to access the swing without unnecessary difficulty, without additional restraints and without the need of outside attendants. The ramp also provides a safety restraint during use of the swing.

SUMMARY OF THE INVENTION

Accordingly, it is a primary object of the invention to provide a lawn swing that is accessible to wheelchair bound users.

It is a further object of the invention to provide a free standing swing having a support platform and pivoting ramp assembly for accessing the swing.

It is a further object of the invention to provide a support platform and hinged access ramp platform which pivots between an access position and a safety restraint position.

It is a further object of the invention to provide a linkage for raising and lowering the ramp platform, which linkage in a screw driven assembly is operated from a hand crank arm.

It is a further object of the invention to provide a swing having a ground platform which mates to the access ramp platform.

Various of the foregoing objects, advantages and distinctions of the invention are obtained in a free standing swing which includes a support platform that supports a wheelchair. The support platform includes an access ramp platform which is supported to rotate between a reclined access position, when the platform contacts the ground, and a raised safety restraint position. The support platform is supported to a multi-user swing frame with truss and bracket arms at a footrest platform and support frame members. The support platform can also be supported from chains or the like suspended from a swing support framework.

A hand crank and screw gear drive cooperate with the access ramp platform to rotate the ramp between lowered and raised conditions. Multiple and single user swing assemblies outfitted with the access ramp assembly of the invention are discussed below with respect to the appended drawings.

Still other objects, advantages and distinctions of the invention, as well as other constructions are more apparent at the following description with respect to the appended drawings. Similar structure is identified at the various drawings with similar reference characters or numerals. To the extent various modifications and improvements have been considered, they are described as appropriate.

The scope of the invention should not be literally construed nor limited by the disclosed assemblies. Rather, the invention should be interpreted to include all those equivalent assemblies within the scope of the further appended claims.

DESCRIPTION OF THE PREFERRED EMBODIMENT

Figure 1:
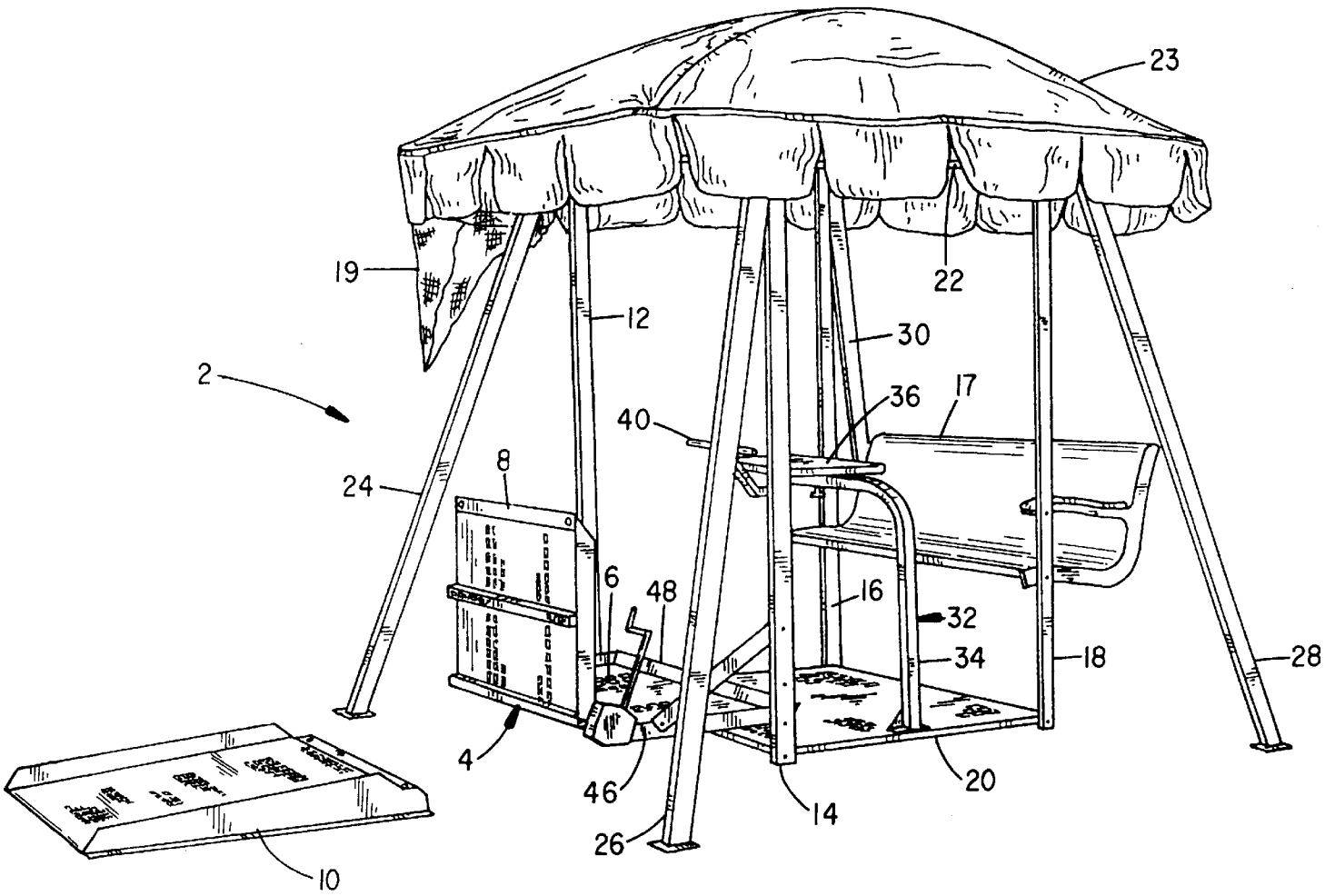
FIG. 1 is a perspective drawing to a free standing, multi-user lawn swing outfitted with a ramp platform to permit access by wheelchair bound users and wherein the ramp is shown in a raised, safety position.
Figure 2:
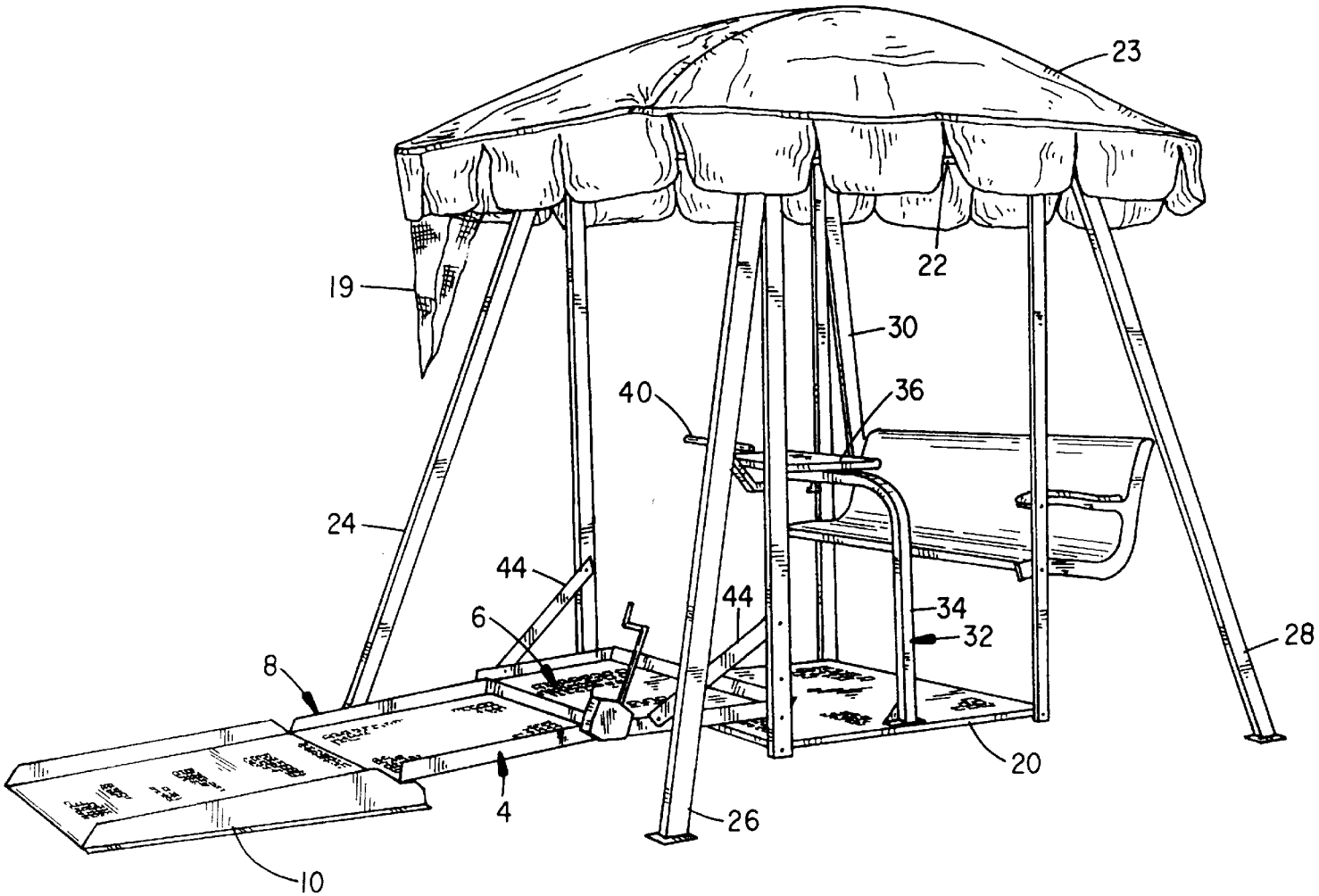
FIG. 2 is a perspective drawing to the lawn swing of FIG. 1 with the ramp lowered into contact with a ground ramp.

With attention to FIGS. 1 through 4, views are shown to a free standing, multi-user lawn swing 2 which has been adapted to facilitate access by wheelchair bound users. The swing 2 includes a wheelchair support assembly 4 which can be raised and lowered to admit wheelchair bound users to a wheelchair support platform 6. An access ramp platform 8 particularly pivots between a raised, safety restraint position, reference FIG. 1, and a lowered access position, reference FIG. 2, to engage the ground or an intermediate ground ramp platform 10. A wheelchair bound user is thereby able to mount and dismount the support platform 6 and make use of the swing 2 as any other user.

The support assembly 4 advantageously provides wheelchair users the opportunity to enjoy the swing 2 and the outdoors, without the need of an attendant to assist in mounting the swing 2. The brakes and other safety restraints provided with the wheelchair can be operated in normal fashion to securely support the user to the support platform 6, when enjoying the swing 2.

The support platform 6 is secured to a pair of upright columns 12 and 14 at one side of the swing 2. Another pair of columns 16 and 18, at the opposite side, support a bench seat 17. The columns 12–18 extend from a footrest platform 20 and couple to pivot couplers (not shown) at an overlying rectangular framework 22. A canopy 23 is supported above the framework 22. A screen or transparent cover 19 can also be suspended from the framework 22 or canopy 23, depending upon weather conditions. Inclined support stanchions 24, 26, 28 and 30 carry the weight and stabilize the swing 2, and which stanchions may be set in cement or secured to ground anchors.

Figure 3:
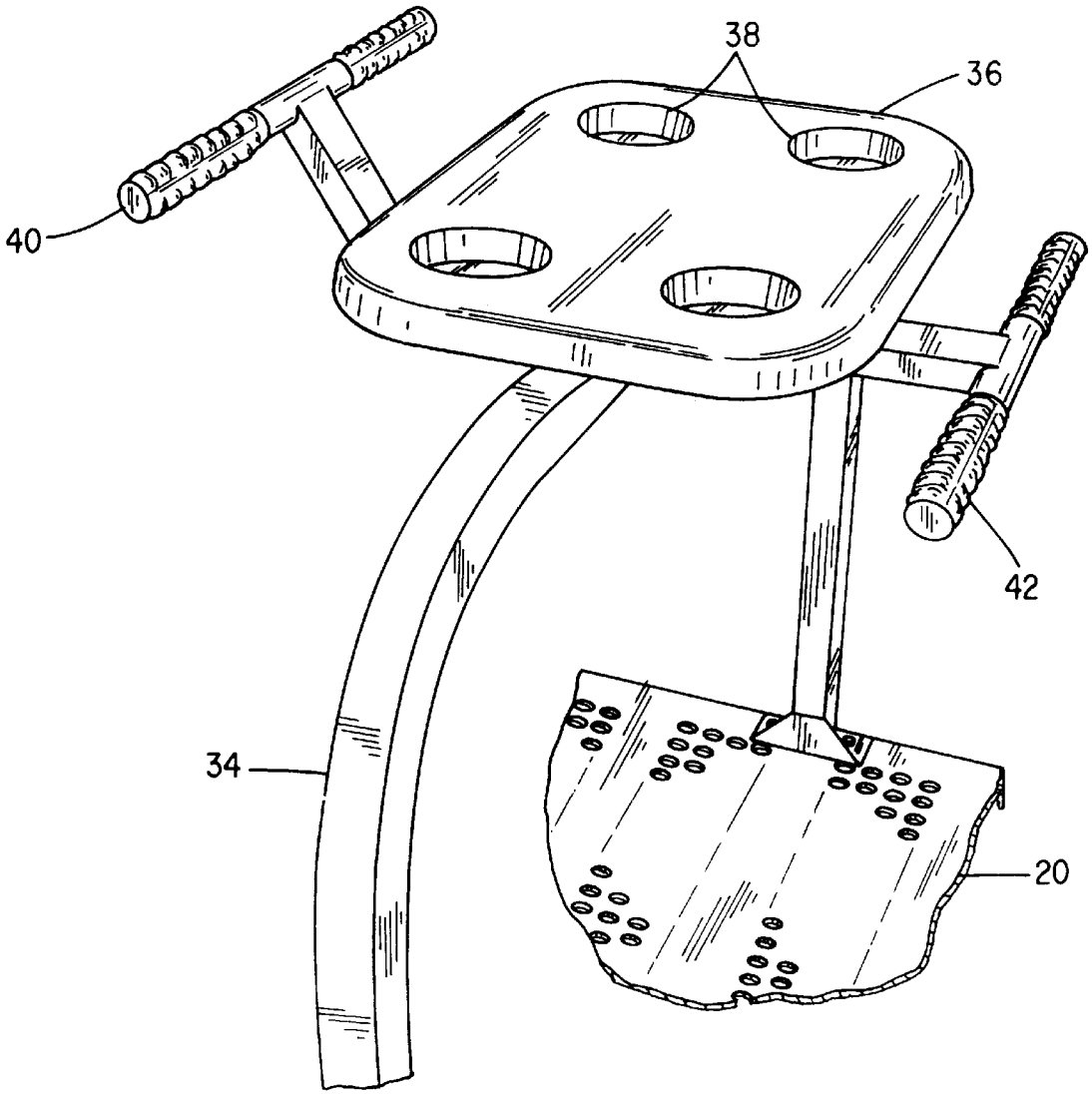
FIG. 3 is a perspective drawing to a table useable with the swing and hand rails.

Secured to a side of the footrest platform 20 is a table assembly 32, see also FIG. 3. A right angle, bent column 34 supports a table top 36 which has a number of drink holder cutouts 38. Hand rails 40 and 42 are secured to the table top 36 and can be gripped by users either seated at a wheelchair on the platform 6 or at the bench seat 17.

Although the swing 2 is outfitted with a single wheelchair support assembly 4, another support assembly 4 can be supported to the columns 16, 18. In the latter instance, a hand rail 40 would be substituted for the hand rail 42 at the table 32.

Figure 4:
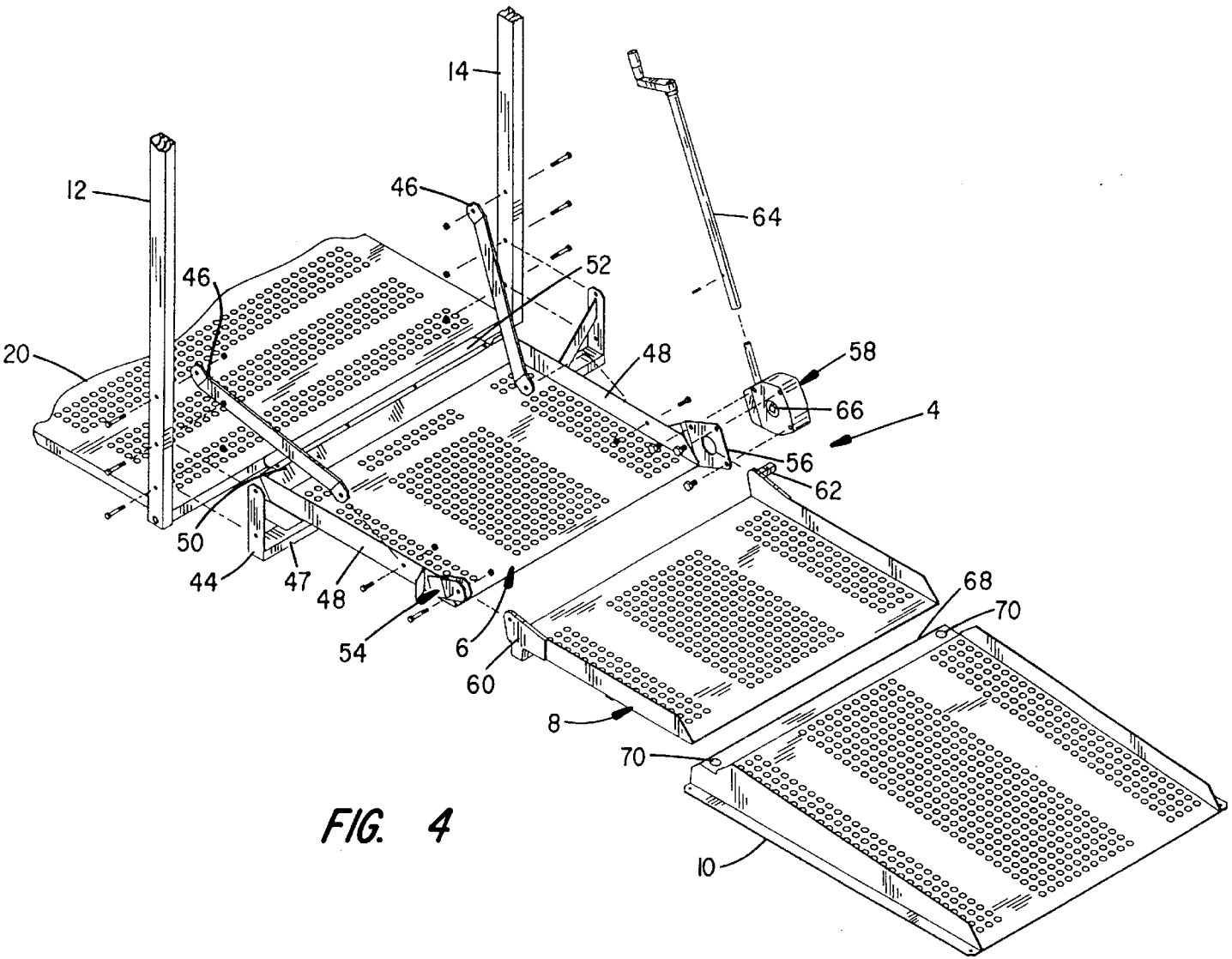
FIG. 4 is a perspective drawing of the access ramp assembly shown in exploded view.

The support assembly 4 is shown in exploded assembly at FIG. 4 and where details to the mounting of the support platform 6 to the columns 12 and 14 are more apparent. The platform 6 is secured is secured to lie in parallel alignment and slightly above the footrest platform 20 with a truss bracket 44. Truss ends of the bracket 44 are bolted to the inside of the columns 12, 14 and depend from the columns 12 and 14. The support platform 6 is supported to a horizontal rail 47 of the bracket 44. Side rails 48 prevent a supported chair from falling off the sides of the platform 6.

A hinge 50 and transition plate 52, i.e. a rubber guard, mount to a fore end of the support platform 6 to cover the space between the platform 6 and footrest platform 20. Where the support platform 6 and transition plate 52 do not align to the footrest platform 20, the plate 52 can be adapted or alternatively a separate rail can be added to prevent a wheelchair from rolling forward with normal swing action, although the brakes provided with wheelchairs have proven sufficient to this end.

Mounted to the aft corners of the platform 6 are a pivot coupler 54 and a crank arm coupler 56. A geared crank assembly 58 is supported to the coupler 56. The ramp platform 8 includes a coupler bracket 60 which mates with the coupler 54. A square shanked drive or pivot arm 62 at the opposite side of the platform 8 mounts through the coupler 56 to the crank housing 58. A hand crank arm 64 extends from the housing 58 and is operable by the wheelchair bound user. As a worm gear drives other gears within the crank assembly 58, a collar 66 which supports the drive arm 62 rotates. The drive arm 64 and ramp platform 8 appropriately follow the rotation of the collar 66. When fully raised, the ramp platform 8 prevents a wheelchair from rolling off the back of the platform 6.

The geared crank assembly 58 permits the ramp platform 8 to be rotated into contact with the ground. Alternatively, the ramp platform 8 can be rotated to engage a ledge 68 of the ground ramp 10. Ground stakes are normally mounted to holes 70 at the ground ramp 10 to assure proper alignment. Depending upon elevation differences between the support assembly 4 and ground, the incline of the ground ramp 10 can be adjusted or multiple ground ramp platforms might be fitted to the platform 10. Additional pivots and link arms might also be fitted to the ramp platform 8 to assure proper unfolding and alignment of each additional ramp platform as the ramp platform 8 is rotated between the access and safety positions.

The swing 2 is constructed from tubular framing members 12–18 and 24–30 and the platforms 4 and 20 are formed from expanded steel. The support and ramp platforms 6 and 8 are similarly constructed from expanded steel panels. All exposed surfaces are treated, covered and/or conditioned to provide a durable and stable swing to support all users. Aluminum or a variety of other weather resistant or coated materials might also be used.

Figure 5:
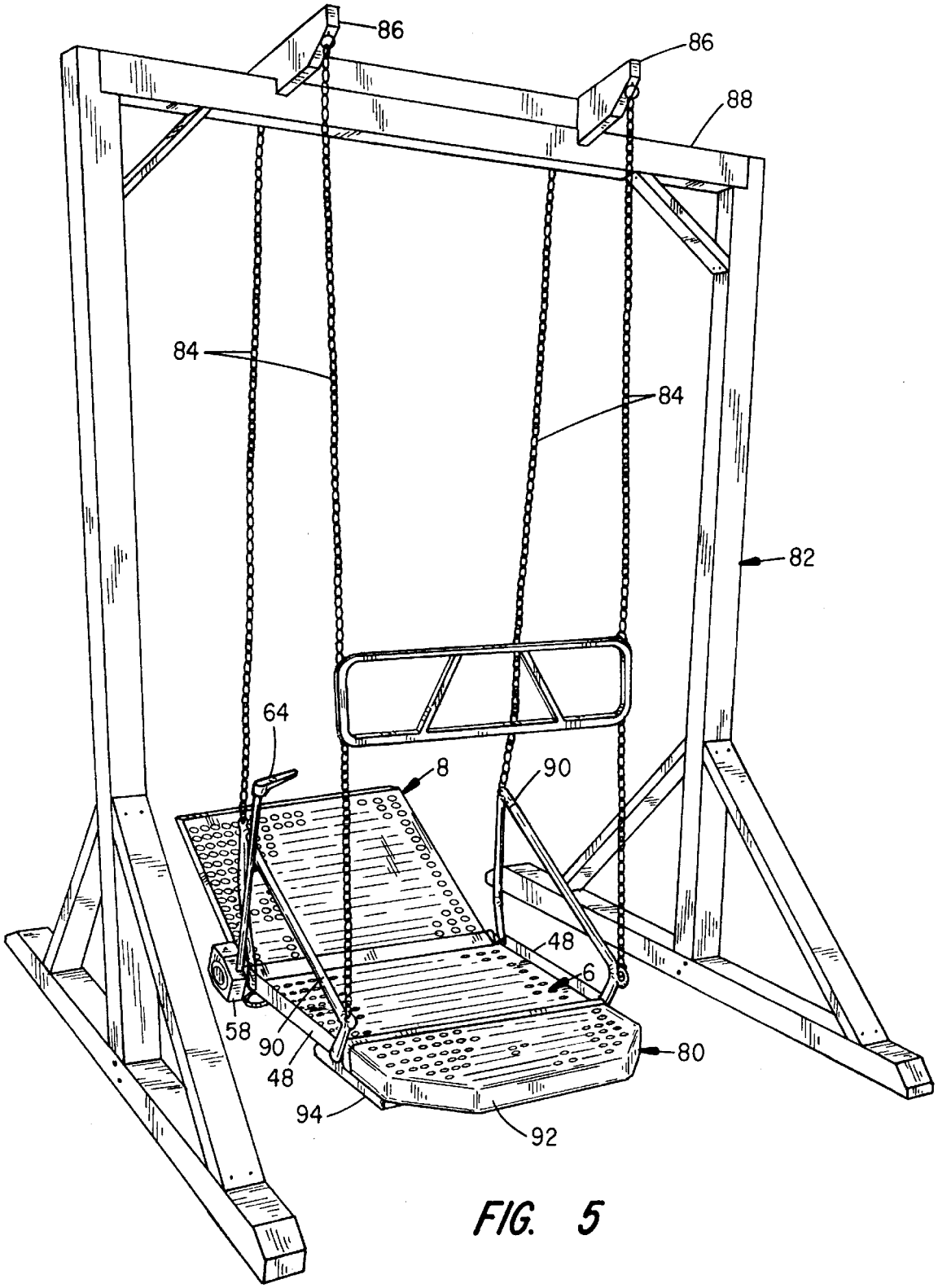
FIG. 5 is a perspective drawing of a single user, wood frame swing fitted with the access ramp assembly of the invention.

With attention to FIG. 5, another wheel chair support assembly 80 is shown mounted to a wooden, swing support framework 82. A number of chains 84 support the assembly 80 from wings 86 that project from a horizontal cross member 88. The chains mount to brackets 90 which project from the sides of the support platform 6. The bracket 90 prevents the wheelchair wheels from snagging the chains 84.

The assembly 80 is constructed essentially the same as the assembly 4, although supports a single user to the swing framework 82. The principle difference is that a separate footrest platform 92 is supported to the front of the platform 6 at a bracket 94.

While the invention has been described with respect to a number of presently considered and preferred configurations, it is to be appreciated still other configurations may be suggested to those skilled in the art upon reference hereto. The invention should therefore be construed to include all those equivalent embodiments within the spirit and scope of the following appended claims.

What is claimed is:

1. A lawn swing comprising:

a) a free standing framework;

b) first and second platforms supported to pivot from said framework; and c) hinge means for securing said first platform to said second platform to rotate between an upright, safety position and a reclined, access position, wherein a gear driven linkage interconnects said first and second platforms, and wherein a crank arm is operable by a wheelchair bound user from either the ground or the second platform to rotate the first platform, whereby the wheelchair bound user can access the second platform via the first platform at said access position and is restrained to said second platform at said safety position.

2. A swing as set forth in claim 1 including a ramp which is supported to the ground and means for mating said ramp to said first platform when rotated to said reclined position.

3. A swing as set forth in claim 1 wherein said gear driven linkage includes a pivot arm and a gear drive means that are coupled at a pivot axis of the first platform.

4. A swing as set forth in claim 3 wherein said framework includes a plurality of vertical columns mounted to pivot at said framework and including a bench seat and a footrest platform mounted to a plurality of said vertical columns and wherein said footrest platform extends parallel to said second platform.

5. A swing as set forth in claim 4 including a table mounted to said footrest platform and hand rails secured to said table.

6. A swing as set forth in claim 1 wherein said framework comprises a plurality of wooden members and wherein a plurality of chains secure said first and second platforms to said framework.

7. A lawn swing comprising:

a) a free standing framework including a plurality of vertical columns and means for supporting said vertical columns to pivot from said framework;

b) a bench seat and a footrest platform mounted to a plurality of said vertical columns;

c) a wheelchair support platform mounted parallel to said footrest platform;

d) an access platform; and e) hinge means for securing said access platform to said wheelchair support platform to rotate between an upright position and a reclined position, wherein a pivot arm and a gear drive means are interconnected at a pivot axis of said access platform, and wherein a hand operated crank arm is coupled to said gear drive means and operable to rotate said access platform by a wheelchair bound user from either the ground or the support platform, whereby the wheelchair bound user can access the support platform via the access platform at said reclined position and be restrained to said support platform at the upright position.

8. A swing as set forth in claim 7 wherein the pivot arm is secured to one of said access and support platforms and mounts to a coupler of said gear drive means at the other of said access and support platforms, which coupler rotates the pivot arm and access platform.

9. A swing as set forth in claim 7 wherein said wheelchair support and access platforms each include side rails.

10. A swing as set forth in claim 7 including a ground ramp that is supportable to the ground and means for coupling said access platform to said ground ramp when rotated to said reclined position.

11. A swing as set forth in claim 10 including stakes for securing said ground ramp to the ground.

12. A lawn swing comprising:

a) a free standing framework;

b) first and second platforms supported to pivot from said framework; and c) a pivot pin and a pivot arm coaxially mounted along a pivot axis of said first platform, wherein said pivot arm is coupled to a gear drive means and a hand operated crank arm extends from said gear drive means and is operable by a wheelchair bound user from either the ground or the second platform for rotating said pivot arm and said first platform between an upright, safety position, and a reclined, access position.

13. A swing as set forth in claim 12 wherein said pivot arm mounts to a coupler of said gear drive means at the pivot axis, wherein said gear drive means includes a worm gear and wherein said crank arm rotates said worm gear and coupler and thereby the access platform.

* * * * *